United States Patent [19]

Shumays et al.

[11] Patent Number: 4,896,893

[45] Date of Patent: Jan. 30, 1990

[54] ICE SKATEBOARDS

[76] Inventors: Adam A. Shumays; Sami A. Shumays; Ibrahim K. Abu-Shumays, all of 1248 Varner Rd., Pittsburgh, Pa. 15227

[21] Appl. No.: 383,257

[22] Filed: Jul. 21, 1989

Related U.S. Application Data

[62] Division of Ser. No. 290,372, Dec. 29, 1988, abandoned.

[51] Int. Cl.[4] ..... A63C 1/36

[52] U.S. Cl. ..... 280/14.2; 280/7.14; 280/28.15; 280/87.042

[58] Field of Search ..... 280/7.12, 7.13, 7.14, 280/11.14, 11.18, 14.2, 21.1, 22.1, 28.15, 28.16, 87.042

[56] References Cited

U.S. PATENT DOCUMENTS

| | | | |
|---|---|---|---|
| 664,215 | 12/1900 | Hickson | 280/28.15 |
| 2,443,348 | 6/1948 | Flajok | 280/28.15 |
| 4,114,913 | 9/1978 | Newell et al. | 280/7.14 X |
| 4,225,145 | 9/1980 | Carr | 280/7.14 |
| 4,521,029 | 6/1985 | Mayes | 280/87.042 X |
| 4,653,763 | 3/1987 | Schulte | 280/28.15 |
| 4,744,576 | 5/1988 | Scollan, Jr. | 280/87.042 |

*Primary Examiner*—Charles A. Marmor
*Assistant Examiner*—Michael Mar

[57] ABSTRACT

An ice skateboard has front and rear trucks with horizontal axles attached thereto for pivotal steering movement of the axles in response to tilting of the skateboard. Each of the horizontal axles has a pair of runner blades attached thereto. An auxiliary blade assembly is attached to each side of the skateboard between the front and rear trucks and in tandem with the runner blades attached to the axles. Each of the auxilary blade assemblies include a mounting arrangement which permits pivotal movement of the auxiliary blade relative to the longitudinal axis of the skateboard.

1 Claim, 2 Drawing Sheets

ICE SKATEBOARDS

This application is a division of application Ser. No. 07/290,372, filed 12/29/88 now abandoned.

BACKGROUND OF THE INVENTION

1. Field of the Invention

This invention combines concepts of ice skates and skateboards to introduce a new winter sport with new challenges and new techniques.

2. Description of the Prior Art

Ice skating is the sport of gliding over a smooth, icy surface on skates. Ice skating can also be performed on special synthetic material to simulate an icy surface and make it possible to ice skate under various weather conditions. An ice skate is a shoe or boot with a blade of suitable form attached to a central line along the bottom of its heel and outsole. There are various types of skates commonly referred to as figure skates, racing skates, and hockey skates.

More recently, skateboards were introduced and are currently very popular. A skatboard is a board or deck of certain shape with wheels attached to the bottom of it by suitable means. Intricate maneuvers can be achieved on skatebards by those skilled in the art.

This invention constructs ice skateboards by attaching one or more blades to a board or deck, and thus introduces a variety of new challenges.

SUMMARY OF THE INVENTION

This invention introduces a class of ice skateboards comprised of (a) a board to be referred to as a deck which is of the same general shape as the decks of standard skateboards, and (b) one or more (a set of) blades attached to the bottom of the deck by appropriate means. The edge of a blade intended for contact with the icy surfaces is slightly curved. One or both ends of each blade may be designed to have teeth. The objective of this invention is to promote a new type of skating on a smooth icy surface or a smooth synthetic surface.

The preferred embodiments include a deck with one, two, or three blades attached perpendicular to the bottom of the deck in a manner analogous to the way a blade is attached to the bottom of a shoe or booth of an ice skate. An alternative arrangement would make it possible to rotate some of the blades slightly.

The preferred embodiments also include variations on the now standard skateboards where the four wheels of a skateboard can be removed and replaced by a set of two or four main blades. Additional blades can be added to provide extra stability and maneuverability. The main blades in an ice skateboard (like the wheels in a standard skateboard) are mounted on what is referred to as two truck assemblies which are mounted to the bottom side of the deck. This part of the invention can be viewed as improvements and extensions to the existing skateboards.

The deck may be made of fiberglass that is reinforced with epoxy, strong plastic, real wood, exterior plywood, metal, etc., or a combination of different materials. The main difference between the deck needed here and some of the decks used for skateboards, is the need for durability under severe cold weather conditions in an outdoor environment. For example, wood should be pressure treated and if plywood is used, it should be of high grade, constructed using special waterproof glue between plies.

The various accessories used on standard skateboards can be applied to each of the alternative embodiments of the present invention. Accessories include rails or slide bars, nose gaurd, tail skid plate, grip tape, etc. There is a desire here for redesign of the tail skid plate to enhance braking power on ice or ice-like surfaces. The tail skid plate is redesigned here to have either very wide teeth or a structure like that adopted for snow tires or for the bottom of boots. Grip tape is used to cover parts or all of the top surface of the deck. The top surface of the tape is rough, like durable coarse sand paper, and provides a non-skid surface for standing on the deck. For the ice skateboards of the present invention, it is desirable to develop newer grip tape with a much coarser granulated surface. Alternatively, the top surface could be designed to have rubber-like threads, typically $\frac{1}{8}$ to $\frac{1}{4}$ inches thick, such as is used at the bottom of some boots to provide extra grip for added safety in ice boarding.

Safety protective gear is also to be strongly emphasized. This includes knee pads, elbow pads, shin guards, wrist guards, helmets such as used by hockey players to provide warmth and also to provide an extension to the helmets in the form of a chin guard.

Some of the above items are self-evident and are not discussed further below. Exact dimensions are not mentioned, since this is a relative matter and can be varied. Relative dimensions are provided where essential.

BRIEF DESCRIPTION OF THE DRAWINGS

The following drawings illustrate examples of the basic shapes which are the subject of this invention. Component parts shown with the same numbering scheme in different figures are either the same, or are alternative embodiments of corresponding structures.

DESCRIPTION OF THE PREFERRED EMBODIMENTS

Other objects and advantages of this invention will become more apparent from a study of the description of the drawings given above and from the additional description given below. The main objective of the present invention is to contribute to a sport of ice boarding.

Figure 1:
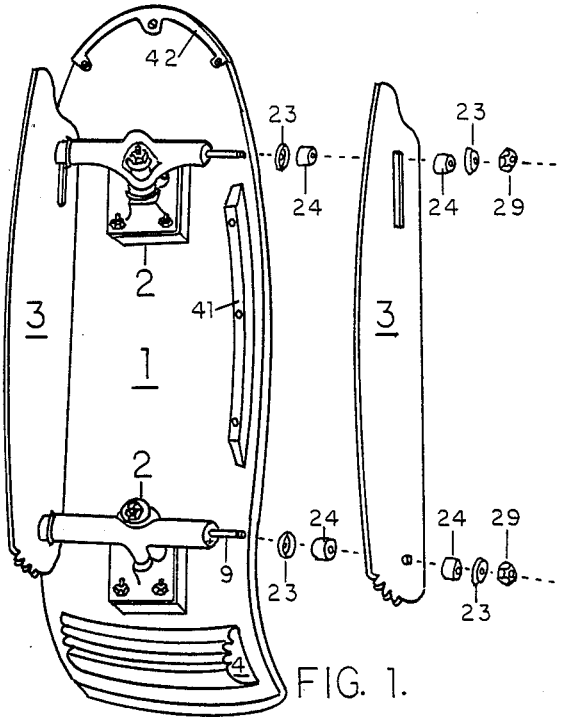
FIG. 1 is a perspective view of an ice skateboard constructed from a standard skateboard by replacing the four wheels of the skateboard by two blades. This figure also shows how a blade is assembled to the structure.
Figure 2:
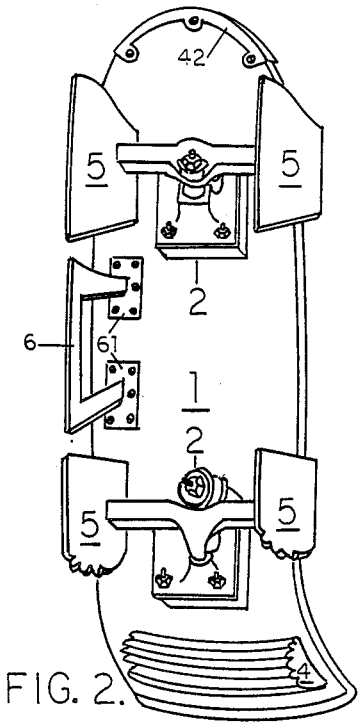
FIG. 2 is a perspective view of a second ice skateboard constructed from a standard skateboard by replacing each of the four wheels of the skateboard by a blade. Two additional blades, like the blade 6 shown in this figure can be added, one on the left as shown and one on the right (the one on the right is not shown for clarity of the illustrations), in order to provide added stability, and the ability to turn while more weight is exerted on one side of the deck of an ice skateboard.
Figure 3:
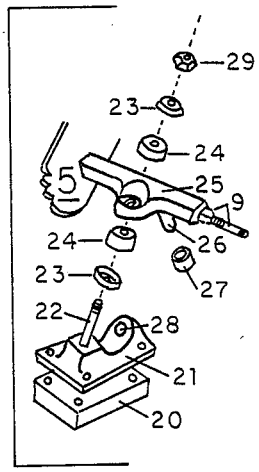
FIG. 3 is a perspective view showing various component parts of what is referred to as a truck for blade support. This figure shows how the truck is assembled from its various component parts.
Figure 4:
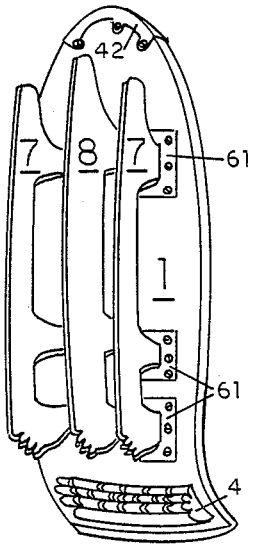
FIG. 4 is a perspective view of an alternative design of an ice skateboard where three blades are attached to a deck or board in the same manner as the blades are attached to a shoe or boot of an ice skate. The middle blade 8 is bigger than the other two blades and is intended to be the only blade which is always in contact with the ice or icy surface. This middle blade can be removed to result in a two-blade ice skateboard.

Examples of the preferred embodiments of this invention are shown in FIGS. 1 to 6 discussed above. The notation of right side, left side, front, and back or rear of an ice skateboard refer in this specification to the respective sides of the board as would be viewed by a person ice boarding on it. For illustration, the front sides of the ice skateboards of FIGS. 1, 2, and 4 are their top parts shown in these figures.

The preferred embodiments of this invention shown in FIGS. 1 to 3 are variations on standard skateboards where the wheels of a skateboard can be disassembled and blades can be assembled in place of the wheels, and the process of replacing wheels by blades can be reversed. Alternatively, as will become clear from the discussion below, an ice skateboard of the type shown in these figures can be made to stand alone, not convertible into a skateboard. The basic components of an ice skateboard of FIGS. 1 to 3 are (i) deck or board, (ii) two trucks, (iii) blades (also wheels to replace blades for convertible constructs), and (iv) mounting hardware. The word truck as used here and in the claims is not to be confused with motor trucks, has the same significance as for skateboards, and refers to the structure below the deck or board that holds the blades or wheels.

FIG. 1 shows the first preferred embodiment of this invention to be a variation of a standard skateboard comprised of (i) a deck 1, (ii) two trucks 2 mounted on the deck, (iii) a sample of auxiliary parts such as a tail skid plate 4, the rails slider bars 41, and the nose guard 42, (iv) two blades 3 and four wheels that can be used interchangeably (the wheels and associated hardware are not shown since these belong to the prior art), and (v) mounting hardware. Each hanger (See 25 in FIG. 3 described below) or top part of a truck has two approximately one-inch long (this dimension can be changed) bolt-like extensions 9 to form external parts and sides of an axle for the truck used normally for assembling (hanging) the wheels of a skateboard. The two trucks in FIGS. 1 and 2 are mounted in such a way that their respective axles are parallel to each other in their rest positions. Here the four wheels are disassembled and replaced by two blades. This figure shows how a blade is assembled to the structure. The blade has a circular hole and a slit having the same width as the circular hole and essentially the same width as the bolt-like extension 9 to the hanger of a truck. The reason for the slit is to allow for variations in possible distances between trucks and for possible use and application of a given blade structure to different skateboards. The blade 3 is assembled as shown in FIG. 1 by inserting around the bolt-like end 9 an inner cup washer 23 (this inner cup washer can be eliminated), an inner cushion or bushing 24, the hole or slit of the blade 3, an outer cushion or bushing 24, an outer cup washer 23, and a tension nut 29. The tension nut can be tightened to an appropriate desired torque.

FIG. 2 illustrates two distinct variations to the ice skateboard of FIG. 1. In the first variation, the blade 6 and its associated blade base 61 in FIG. 2 are to be omitted and essentially each blade 3 of FIG. 1 is replaced here by two smaller blades 5, one corresponding to each truck (in other words the construction here is achieved from a standard skateboard by replacing each of the four wheels of the skateboard by a separate blade 5). The second variation to the ice skateboard of FIG. 1 is obtained from the first by adding two blades, like the blade 6 shown in FIG. 2, one on the left as shown and one on the right (the one on the right is not shown for clarity of the illustrations). The additional blades 6 are fixed in place and provide both added stability, and the ability to turn while more weight is being exerted on one side of the deck of an ice skateboard. Normally, the additional blades 6 are elevated and touch the ground (icy surface) one at a time and only as a result of weight being exerted on one side of the deck. The auxiliary blades 6 can be made to rotate slightly as is described in connection with FIG. 6 below. Each of the front or back pairs of blades 5 associated with a given truck 2 should have identical shapes, but the different pairs may or may not have the same shape.

FIG. 3 shows various component parts of a truck 2 of FIGS. 1 and 2 which is used to interchangeably support wheels or blades. This figure also shows how the truck is assembled. Part of a blade 5 is shown in this figure and this part is to be viewed as being either part of a blade 5 of FIG. 2 or part of a blade 3 of FIG. 1. A truck is typically assembled from the following:

(i) A riser pad 20 typically made of hard plastic, and a base plate 21 which has the structure shown. A bolt 22 with a square or hexagonal head passes though the base plate 21 and the arrangement is such that when the bolt is fully inserted in the plate's inner side, the head of the bolt is held firmly in place in such a way as to prevent rotation of the bolt. The plate also has a cylindrical indentation 28 which can accommodate a cushion pad 27 and a pivot part 26 of the hanger 25 described below. The base plate and riser pad are secured in place to the bottom side of the deck 1 by screws and tension nuts as is indicated in FIGS. 1 and 2. The base plate and riser pad can also be combined into a single component part which can be made of metal or other hard material.

(ii) A hanger 25 having a part which functions as a double cup washer with a slit inside it; the slit is intended to accommodate the bolt 22 but is sufficiently wider than the bolt to make it possible to move the hanger slightly relative to the bolt. The hanger 25 has a pivot 26 and a bolt-like axle 9 to hold blades or wheels. The rest of a truck is assembled as shown in FIG. 3 by inserting around the bolt 22 an inner cup washer 23 (this inner cup washer can be eliminated), an inner cushion or bushing 24, the hold or slit of the hanger 25; the pivot part 26 of the hander is inserted in the cushion pad 27 which is further inserted in the cylindrical indentation 28 of the base plate 21. Also inserted around the bolt 22 above the hanger 25 are an outer cushion or bushing 24, an outer cup washer 23, and a tension nut 29. The tension nut can be tightened to an appropriate desired torque. The sizes of some of the component parts in the various figures are exaggerated for ease of illustration.

Comparison of the bolt-like ends 9 of the axle of the hangers in FIGS. 1 and 3 shows a modification in FIG. 3 desirable for the preferred embodiment of FIG. 2. Here, the inner part of the bolt-like ends 9 of the axle is modified to have a square or hexagonal part. The corresponding inner cup washer 23 and inner cushion 24 of FIG. 3 would have corresponding square or hexagonal holes in place of the circular holes, the axle 9 would have to be made a little longer in this case in order to accommodate an inner cup washer 23 and/or an inner cushion 24 before the wheels, if a person is to be able to convert the ice skateboard to a standard skateboard on wheels.

The blades 5 of FIG. 2 can be assembled to the trucks as is described above in connection with the blades of FIG. 1. In this case, the tension nut has to be screwed tight enough to prevent a blade 5 from rotating if weight is exerted at the front or the back of a deck to achieve certain maneuvers. Three preferred new arrangements are (a) to have a pair of blades 5 fixed permanently (soldered together or manufactured as a unit) to each hanger 25, (b) to have the end 9 of the axle 25 modified as shown in FIG. 3, and in this case to have a corresponding square or hexagonal hole in the blade 5; the square or hexagonal hole of the blade 5, with two (preferrably spring lock) washers around it, are inserted around the modified part of the axle 9 and a tension bolt is screwed to hold the blade 5 in place and prevent the blade from rotating relative to the hanger 25, and (c) to carge or make indentations, for example where the very small plus sign is marked on the hanger adjacent to the axle part 9 of FIG. 1; in this case, the washer and the blade would have corresponding protrusions so as to prevent the blade 5 from turning relative to the hanger.

FIG. 4 is a perspective view of an alternative design of an ice skateboard where three blades are attached to a deck or board in the same manner as a blade is attached to a shoe or boot of an ice skate. Each blade here is shown to have three bases 61 to support it. The exact number M of blade bases 61 to support any blade of the present invention, need not be three; M can be one or more, though two or three (M=2 or M=3) are to be preferred.

The middle blade 8 in FIG. 4 is bigger and higher than the other two blades 7 and is intended to be the only blade which is always in contact with the ice or icy surface. This middle blade 8 can be removed, to result in a two-blade ice skateboard where the blades 7 are assembled parallel to each other. In the embodiment of three blades, the blades 7 may be assembled parallel to blade 8, or possibly with a very small angle relative to blade 8. As a result, when a person ice boarding leans to one side of the deck so that one of the blades 7 comes in contact with the ground together with blade 8, the slight angle between the blades 7 and 8 will cause the ice skateboard to rotate. The relative angle between blades 7 and 8 can be fixed or the arrangement described below in connection with FIG. 6 can be adapted to blades 7 to make it possible to select any of a range of reasonable angles.

FIG. 4 also shows an alternative design of the tail skid plate 4. The double lines shown indicate indentations, the intended arrangement being similar to the bottom of a boot or the threads of snow tires to provide improved braking on icy surfaces. Clearly, the modified skid plate 4 can also be used for other embodiments and also for a standard skateboard on wheels.

Figure 5:
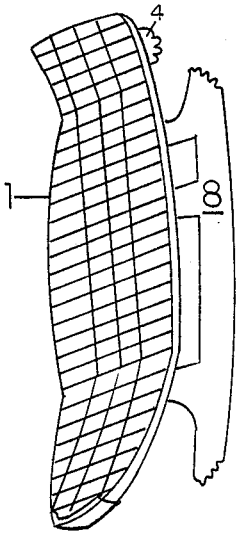
FIG. 5 is a perspective view of an alternative design of the ice skateboard of FIG. 4 with only one blade attached to the underside of the deck.

FIG. 5 shows an alternative design of the ice skateboard of FIG. 4 with only one blade 8 attached to the underside of the deck. Part or all of the top face of the deck is intended to be coverd by a grip tape. The top surface of the tape is rough, like durable coarse sand paper, and provides a non-skid surface for standing on the deck. For the ice skateboards of the present invention, it is desirable to develop newer grip tape with a much coarser granulated surface. Altneratively, the top surface could be designed to have rubber-like threads, typically ⅛ to ¼ inches thick, such as is used at the bottom of some boots to provide extra grip for added safety in ice boarding. The lines marked on the face of the deck 1 in FIG. 1 are intended to indicate the presence of grip tape with lines standing for possible locations of indentations.

Figure 6:
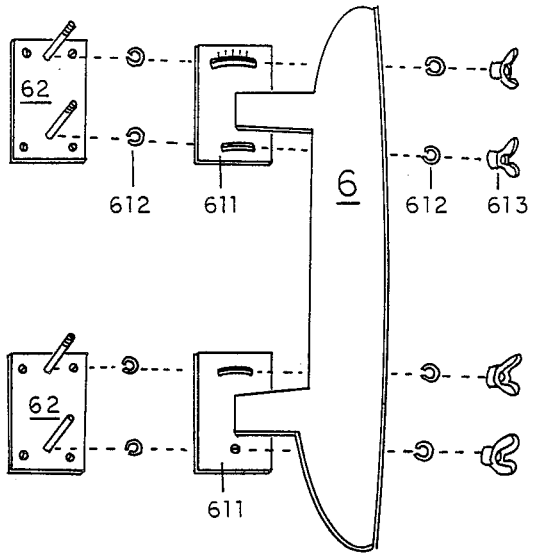
FIG. 6 is a perspective view showing various component parts of a rotatable blade assembly intended for auxiliary and not for primary blades of an ice skateboard.

FIG. 6 shows a redesign of the blade base part 61 of the blade 6 of FIG. 2; the redesign is intended to also apply to a modification of the blades 7 of FIG. 4. Here the blade 6 is permanently fixed to two base plates 611 perpendicular to it. One of the base plates 611 has a circular hole and a slit in the form of an arc of a circle around the center of the first circular hole. The second plate 611 has two slits in the form of arcs of circles around the center of the first circular hole. The marks adjacent to one of the slits is a scale intended to aid in the proper positioning of pairs of corresponding blades such as 6 or 7. Base plates 62 with two bolts fixed to each are screwed or nailed to the bottom side of deck 1. The assembly can now be achieved by inserting washers 612 (preferably spring lock type), the hole and slits of 611, and tension nuts (29 of FIGS. 1 and 3) or wing nuts 613 in the order shown in FIG. 6. A desired orientation of the blade 6 or 7 can be selected and the nut tightened to secure this assembly. Other modifications of this configuration, such as would be obvious to a person skilled in the art can be adopted to make it possible to vary the relative orientation of the blades 6 and 7 of FIGS. 2 and 4 with three blade bases.

While we have illustrated and described several embodiments of our invention, it will be understood that these are by way of illustration only and that various changes, extensions and modifications may be contemplated in this invention and within the scope of the following claims.

We claim:

1. A skateboard for skating on an ice surface comprising:

an elongated body portion having an upper surface and a lower surface, a pair of trucks affixed to the lower surface of said body portion, said trucks having forward and rearward horizontal axles and forward and rearward pivoting mounts positioned in tandem to each other to enable pivotal steering movement of the axles upon tilting of said body portion, first and second pairs of runner blades attached to the outer ends of respective forward and rearward axles to define forward and rearward pairs of longitudinally spaced runner blades arranged in tandem along each side of said body portion, and a pair of auxiliary blade assemblies attached to said lower surface along each side of said body portion between respective forward and rearward runner blades and arranged in tandem therewith, each of said auxiliary blade assemblies comprising a blade having a runner portion with leg portions extending from opposite ends of said runner portion, the lower edge of said runner portion being spaced closer to the lower surface of said body portion than the lower edges of said first and second pairs of runner blades, a first pair of longitudinally spaced mounting plates attached to said lower surface, each of said first pair of mounting plates having a pair of longitudinally spaced bolts affixed thereto and extending perpendicularly therefrom, a second pair of mounting plates attached to respective free ends of said leg portions, one of said second pair of mounting plates having a circular opening and an arc-shaped opening longitudinally spaced from said circular opening, the other of said second pair of mounting plates having a pair of longitudinally spaced arc-shaped openings, each of said arc-shaped openings in said second pair of mounting plates having a radius of curvature equal to the distance between said circular opening and a respective one of said arc-shaped openings, and wing nuts threadedly engageable with said bolts for securing said second pair of mounting plates to said first pair of mounting plates while permitting pivotal movement of said auxiliary blade relative to the longitudinal axis of said elongated body portion.

* * * * *